US005337720A

United States Patent [19]

Murakami et al.

[11] Patent Number: 5,337,720

[45] Date of Patent: Aug. 16, 1994

[54] ENGINE CONTROL METHOD

[75] Inventors: Nobuaki Murakami; Takashi Kawabe, both of Kyoto, Japan

[73] Assignee: Mitsubishi Jidosha Kogyo Kabushi Kaisha, Tokyo, Japan

[21] Appl. No.: 30,237

[22] PCT Filed: Jul. 29, 1992

[86] PCT No.: PCT/JP92/00961

§ 371 Date: May 26, 1993

§ 102(e) Date: May 26, 1993

[87] PCT Pub. No.: WO93/03268

PCT Pub. Date: Feb. 18, 1993

[30] Foreign Application Priority Data

Jul. 30, 1991 [JP] Japan ..... 3-190092

[51] Int. Cl.[5] ..... F02D 43/00; F02D 41/10; F02D 17/02

[52] U.S. Cl. ..... 123/481

[58] Field of Search ..... 123/90.15, 90.16, 198 F, 123/481

[56] References Cited

FOREIGN PATENT DOCUMENTS 118531 9/1981 Japan .
10757 1/1984 Japan .
34430 2/1984 Japan .
40738 3/1985 Japan .
50238 3/1985 Japan .
20839 6/1988 Japan .

*Primary Examiner*—Tony M. Argenbright

[57] ABSTRACT

An engine control method in which a valve drive mechanism and a fuel injection device are controlled by an electronic control unit during transition between a cylinder-off state and a cylinder-on state of a variable-cylinder engine. During transition from the cylinder-on state to the cylinder-off state, the operation of a suction valve and an exhaust valve is stopped when at least one suction stroke is executed after the stoppage of fuel injection. When the operating state is restored from the cylinder-off state to the cylinder-on state, on the other hand, normal combustion is effected immediately after the valve operation is restarted following preliminary fuel injection if the engine is in a rapid-acceleration operation region. In a normal operation mode, the fuel injection is started after the valve operation is restarted. Thus, it is possible to reduce a shock which is attributable to fluctuations of the engine output torque caused during the change between the cylinder-off state and the cylinder-on state.

3 Claims, 7 Drawing Sheets

#1 INJ
IN VALVE LIFT
#3
#5
CHANGE ERROR
AIR CYCLE
#1 INJ
#3 INJ
#5 INJ
A/F
26
18
10
OUTPUT TORQUE (kgf·m)
10
5
0
0.0
0.2
0.4
0.6
TIME ELAPSED (sec)

ENGINE CONTROL METHOD

TECHNICAL FIELD

The present invention relates to an engine control method, and more particularly, to an engine control method applied to a variable-cylinder engine whose operating state is changeable between a cylinder-off state, in which the operation of the engine for some cylinders is stopped, and a cylinder-on state, and in which fluctuations of the engine output caused by the change of the engine operating state can be reduced.

BACKGROUND ART

While a motor vehicle is running very normally on an ordinary road, it does not require a very high engine output, and is expected only to produce half the engine output that the motor vehicle can produce. Thus, a motor vehicle furnished with a multi-cylinder engine may be designed so that the engine operation for some of its cylinders can be stopped to reduce the output in this running state, whereby the fuel-cost performance can be improved.

Conventionally proposed, therefore, is a variable-cylinder engine which can be operated in either a cylinder-off state, in which the engine operation is stopped for some specific ones of its cylinders, or a cylinder-on state, in which the engine operation is performed for all of the cylinders. When operating the conventional variable-cylinder engine in the cylinder-off state, rocker arms of the specific cylinders are rocked idle to stop the operation of suction and exhaust valves, whereby the operation of valve drive mechanisms associated with these cylinders is stopped. Thus, in the case of a 6-cylinder engine, for example, the engine operation is stopped with respect to, e.g., three cylinders. In changing the operating state between the cylinder-off state and the cylinder-on state, moreover, the valve drive mechanisms for each cylinder and a fuel supply system (e.g., fuel injection system) are controlled so that they are operated in associated with each other, thereby ensuring normal combustion in the cylinders.

However, the conventional variable-cylinder engine control method is subject to a drawback such that the engine output greatly fluctuates, thereby producing a shock, during the change between the cylinder-off state and the cylinder-on state, or a spark plug smolders.

DISCLOSURE OF THE INVENTION

An object of the present invention is to provide an engine control method in which fluctuations of the engine output caused by change between a cylinder-off state and a cylinder-on state can be reduced.

Another object of the present invention is to provide an engine control method in which fluctuations of the engine output caused during transition from tile cylinder-off state to the cylinder-on state can be reduced, in particular.

Still another object of the present invention is to provide an engine control method in which fluctuations of the engine output caused during transition from the cylinder-on state to the cylinder-off state, in particular, and smoldering of a sparking plug can be eliminated.

In order to achieve the above objects, according to the present invention, there is provided an engine control method in which a valve operation in valve drive mechanism associated with at least one specific cylinder is limited to permit a reduction in the number of cylinders, and fuel injection is controlled depending on the operating conditions of the valve drive mechanism, while an engine is being operated in a specific operation region.

According to one aspect of the present invention, the engine control method comprises: previously injecting fuel into the specific cylinder, then restoring the valve operation in the valve drive mechanism associated with the specific cylinder, and effecting normal combustion in the specific cylinder on restoring the valve operation, during the change of the operating state of the engine from a cylinder-off state to a cylinder-on state and in the case where the engine is in a rapid-acceleration operation region; and restoring the valve operation in the valve drive mechanism associated with the specific cylinder and then starting fuel injection into the specific cylinder, during the change of the engine operating state from the cylinder-off state to the cylinder-on state and in the case where the engine is in a normal operation region.

According to another aspect of the present invention, the engine control method comprises stopping fuel injection into the specific cylinder and then stopping the valve operation in the valve drive mechanism associated with the specific cylinder after at least one suction stroke is executed in the specific cylinder, during the change of the operating state of the engine from a cylinder-on state to a cylinder-off state.

As described above, according to the one aspect of the present invention, during the change of the operating state of the engine from the cylinder-off state to the cylinder-on state, the valve operation is reset after previously injecting the fuel in the case where the engine is in the rapid-acceleration operation region, and the fuel injection is started after the valve operation is reset in the case where the engine is in the normal operation region. Therefore, fluctuations of the engine output which are caused during the change from the cylinder-off state to the cylinder-on state can be reduced, and an output fit for the engine operation region for the change of the engine operating state can be produced.

According to the other aspect of the present invention, moreover, the fuel injection is stopped and the valve operation is then stopped after the execution of the suction stroke, during the change from the cylinder-on state to the cylinder-off state, so that fluctuations of the engine output which are caused during the change from the cylinder-on state to the cylinder-off state can be reduced, and smoldering of the spark plug can be eliminated.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

PREFERRED EMBODIMENTS OF THE INVENTION

The following is a description of the concept of an engine control method according to the embodiment of the present invention.

Figure 1:
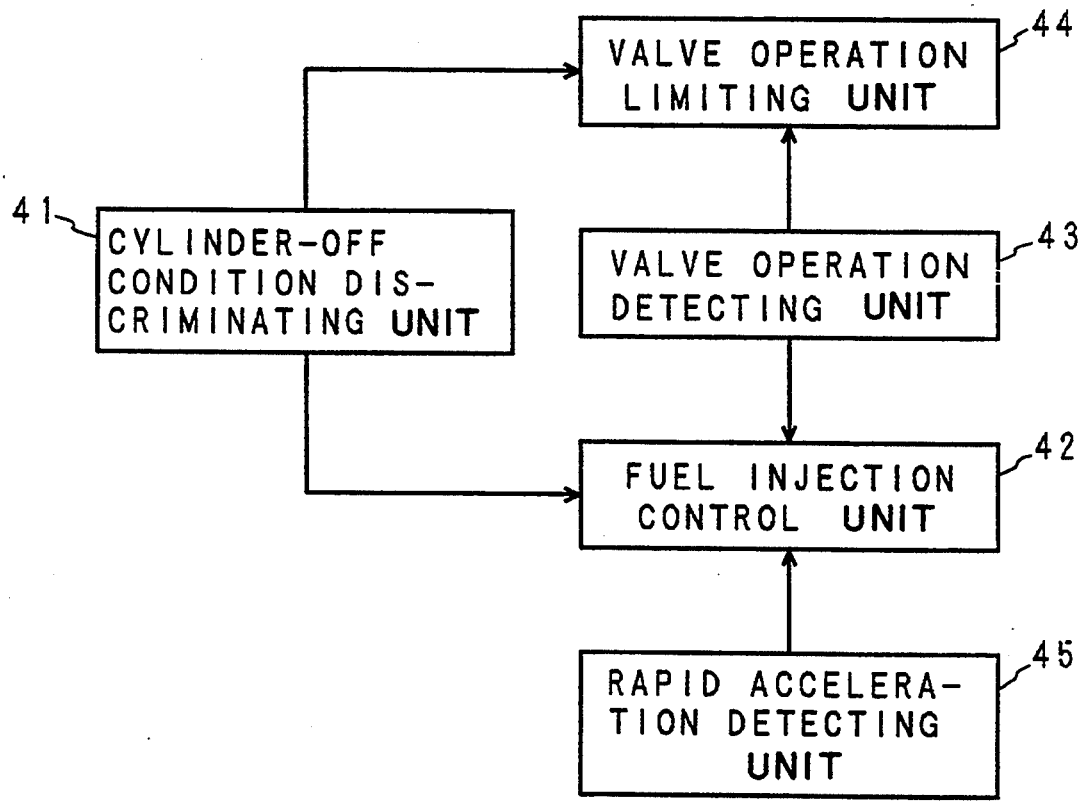
FIG. 1 is a schematic block diagram generally showing an apparatus for carrying out an engine control method according to the present invention.

The method for an embodiment of the present invention, which allows a multicylinder engine to operate in either a cylinder-off state or a cylinder-on state, is carried out by means of an apparatus shown in FIG. 1. Here let it be supposed that the engine is operated in the cylinder-on state, so that the engine operation is effected for all cylinders of the engine.

During this engine operation, it is periodically determined by a cylinder-off condition discriminating unit 41 whether or not the engine is being operated in a specific operation region, e.g., a low-load operation region. If it is concluded that the engine is in any other operation region than the specific operation region, so that the cylinder-off conditions are not satisfied, the engine operation in the cylinder-on state is continuously performed.

If it is concluded, thereafter, that the engine has entered the specific operation region so that the cylinder-off conditions are satisfied, the cylinder-off condition discriminating unit 41 delivers a fuel injection stop signal to a fuel injection control unit 42 and a valve operation limiting unit 44. The limiting unit 44 is provided for each of valve drive mechanisms (not shown) associated with some cylinders (hereinafter referred to as suspendible cylinders) whose operation is to be stopped in the cylinder-off state. In response to the fuel injection stop signal, the fuel injection control unit 42 drives a fuel injection apparatus (not shown) so that fuel injection into the suspendible cylinders is stopped. A valve operation detecting unit 43, which is provided for each of the valve drive mechanisms associated with the suspendible cylinders, delivers a valve operation signal to its corresponding valve operation limiting unit 44 when the valve operation detecting unit 43 detects the completion of at least one suction stroke in one of the suspendible cylinders. When the fuel injection stop signal and the valve operation signal are inputted in succession, the valve operation limiting unit 44 stops the valve operation of its corresponding valve drive mechanism. In this manner, the valve operations of the respective valve drive mechanisms of the individual suspendible cylinders are successively stopped, so that the number of operating cylinders in the engine is reduced, thus establishing the cylinder-off state. In this cylinder-off state, the fuel injection control unit 42 controls the fuel injection in accordance with the operating state of the valve drive mechanisms. Thus, the fuel injection into the suspendible cylinders is stopped, while fuel injection into the other cylinders is carried out periodically.

While the operating state is changed from the cylinder-on state to the cylinder-off state, as described above, the fuel injection into some cylinders whose operation is to be stopped is first stopped, and the valve operation associated with the suspendible cylinders is then stopped after the completion of at least one suction stroke. As a result, only air is sucked into the suspendible cylinders immediately before the stoppage of the valve operation, thereby preventing combustion gas from being confined to the cylinders. In consequence, fluctuations of the engine output torque which are caused during transition from the cylinder-on state to the cylinder-off state is reduced, and smoldering of a spark plug in the suspendible cylinders can be eliminated.

If it is concluded, thereafter, that the engine has left the specific operation region so that the cylinder-off conditions have been canceled, the cylinder-off condition discriminating unit 41 delivers a valve operation restoration signal to the valve operation limiting unit 44. Under the control of the valve operation limiting unit 44 which operates in response to this signal, those valve drive mechanisms associated with the suspendible cylinders are released from the valve operation stoppage. Further, whether or not the engine is in a rapid-acceleration operation region is detected by a rapid acceleration detecting unit 45. If the engine is in the rapid-acceleration operation region, preliminary fuel injection into the suspendible cylinders is carried out under the control of the fuel injection control unit 42 which operates in response to a rapid-acceleration operation signal delivered from the rapid acceleration detecting unit 45. When the valve operation detecting unit 43 then detects the valve operation in the valve drive mechanisms associated with the suspendible cylinders, the valve operation detecting unit 43 delivers a fuel injection restoration signal to the fuel injection control unit 42. Under the control of the fuel injection control unit 42, which operates in response to this signal, fuel injection into the suspendible cylinders is started. Since the preliminary fuel injection into the suspendible cylinders is finished, all of the cylinders including the suspendible cylinders undergo normal combustion, thus establishing the cylinder-on state.

On the other hand, if the rapid-acceleration operation region is not detected by the rapid acceleration detecting unit 45, that is, if it is concluded that the engine is in a normal operation region, after the establishment of the cylinder-off conditions is discriminated, a normal operation signal is delivered from the rapid accelerating detecting unit 45 to the fuel injection control unit 42. Subsequently, the valve operation in the valve drive mechanisms associated with the suspendible cylinders is detected by the valve operation detecting unit 43, and the fuel injection restoration signal is delivered from the valve operation detecting unit 43 to the fuel injection control unit 42. When the normal operation signal and the fuel injection restoration signal are inputted in succession, the fuel injection control unit 42 initiates the fuel injection into the suspendible cylinders, thereby establishing the cylinder-on state.

While the operating state is restored from the cylinder-off state to the cylinder-on state in this manner, the preliminary fuel injection into the suspendible cylinders is performed if the engine is in the rapid-acceleration operation region. Immediately after the valve operation in the valve drive mechanisms associated with the suspendible cylinders is restarted, the normal combustion is effected to increase the output. In a normal state, the fuel injection is started after the valve operation is restarted, that is, after only air is sucked into the suspendible cylinders . In consequence, fluctuations of the engine output which are caused during the change from the cylinder-off state to the cylinder-on state are reduced, and an output fit for the engine operation region for the change of the engine operating state is produced.

Referring now to FIGS. 2 to 5, a variable-cylinder engine to which is applied a control method according to a first embodiment of the present invention will be described.

The variable-cylinder engine is formed of a 6-cylinder engine. While the engine is running in the cylinder-off state, the engine operation is stopped with respect to three cylinders (suspendible cylinders) #1, #3 and #5. Valve drive mechanisms are provided on the suction and exhaust sides of six cylinders, individually. Conventional valve drive mechanisms are arranged on the suction and exhaust sides of the three other cylinders except the suspendible cylinders, and a description of those mechanisms is omitted. Valve drive mechanisms of the same construction are arranged on the suction and exhaust sides of the suspendible cylinders. The following is a description of a suction-side valve drive mechanism.

Figure 2:
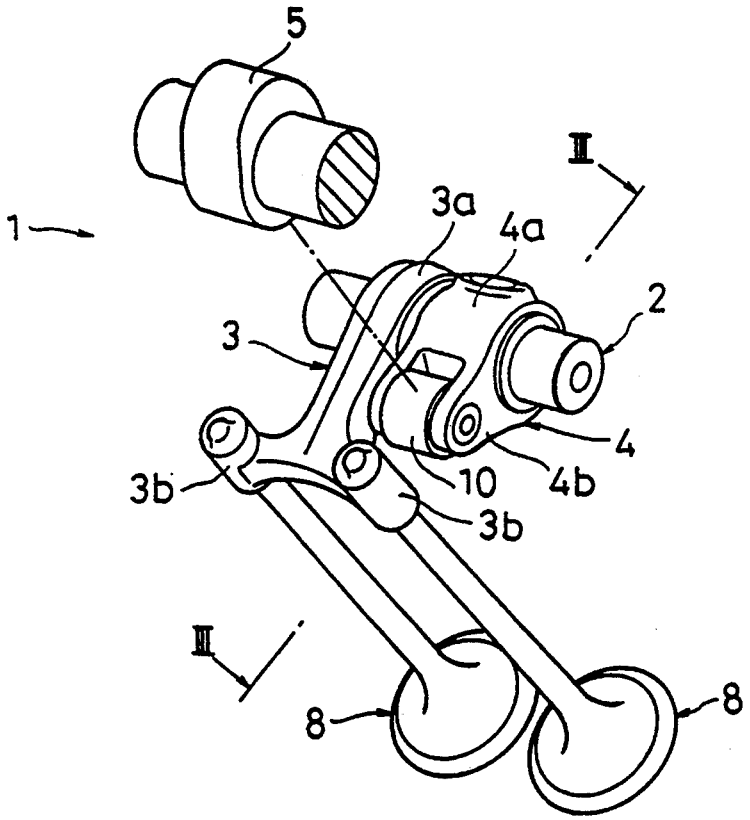
FIG. 2 is a perspective view illustrating a valve drive mechanism for carrying out an engine control method according to a first embodiment of the present invention.
Figure 3:
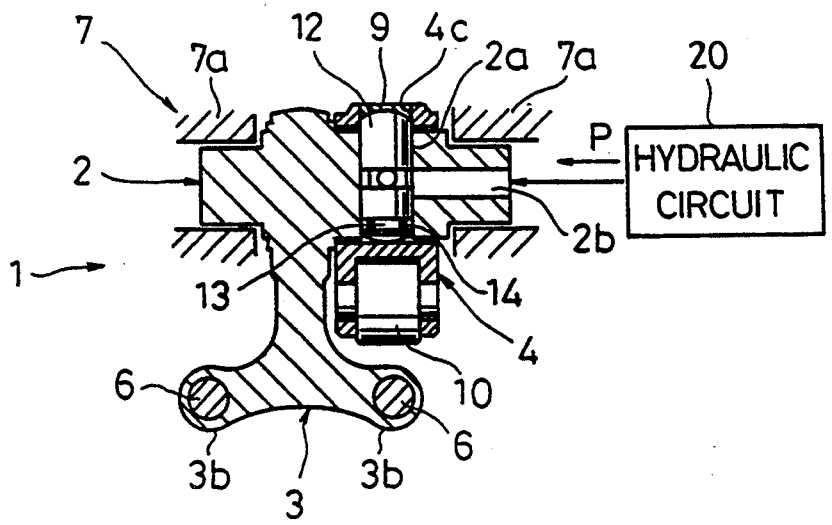
FIG. 3 is a sectional view of the valve drive mechanism taken along line III—III of FIG. 2.

Referring to FIGS. 2 and 3, the suction-side valve drive mechanism 1 of the variable-cylinder engine is composed of a rocker shaft 2, a primary rocker arm (hereinafter referred to simply as "rocker arm") 3, a rocker arm 4, a cam 5, etc. The rocker arm 3, having a proximal end 3*a* fixed to the rocker shaft 2 and forked distal ends 3*b*, 3*b*, is formed into a T-shape as a whole. A lash adjuster 6 is mounted on each distal end 3*b*, 3*b*. The rocker arm 4, which is located on one side of the proximal end 3*a*, has its proximal end 4*a* rockably supported by unit of the rocker shaft 2. Both ends of the rocker shaft 2 are pivotally mounted on bearings 7*a*, 7*a*, individually, which are attached to a cylinder head 7. Also, the distal ends 3*b*, 3*b* of the rocker arm 3 are held against the respective stem heads of suction valves 8, 8 by unit of the rush adjusters 6, 6, individually.

A piston hole 2*a* (FIG. 3) is formed in that portion of the rocker shaft 2 which pivotally supports the proximal end 4*a* of the rocker arm 4, extending in the diametrical direction of the rocker shaft. Further, the rocker shaft 2 is formed with an oil passage 2*b* which, extending along the axis of the rocker shaft, has one end opening into the piston hole 2*a* and the other end opening into one end face of the rocker shaft 2. The oil passage 2*b* is connected to a hydraulic circuit 20 which operates under the control of an electronic control unit 25 (FIG. 4; mentioned later), thereby supplying a predetermined hydraulic pressure P.

A piston hole 4*c* is bored in the proximal end 4*a* of the rocker arm 4 so as to extend in the radial direction of the rocker shaft 2 and in alignment with the piston hole 2*a* of the rocker shaft 2. A lid 9 is fitted in an open end of the piston hole in a liquid-tight manner. Further, a roller 10 is rotatably supported on a distal end 4*b* of the rocker arm 4. The roller 10, which is in contact with the cam 5, rotates as the cam 5 rotates. A projection 4*d* (FIG. 4) is formed on the proximal end 4*a* of the rocker arm 4 so as to be situated on the opposite side with respect to the roller 10. The projector 4*d* is pressed against a distal end 11*a* of a lost motion assembly 11.

Figure 4:
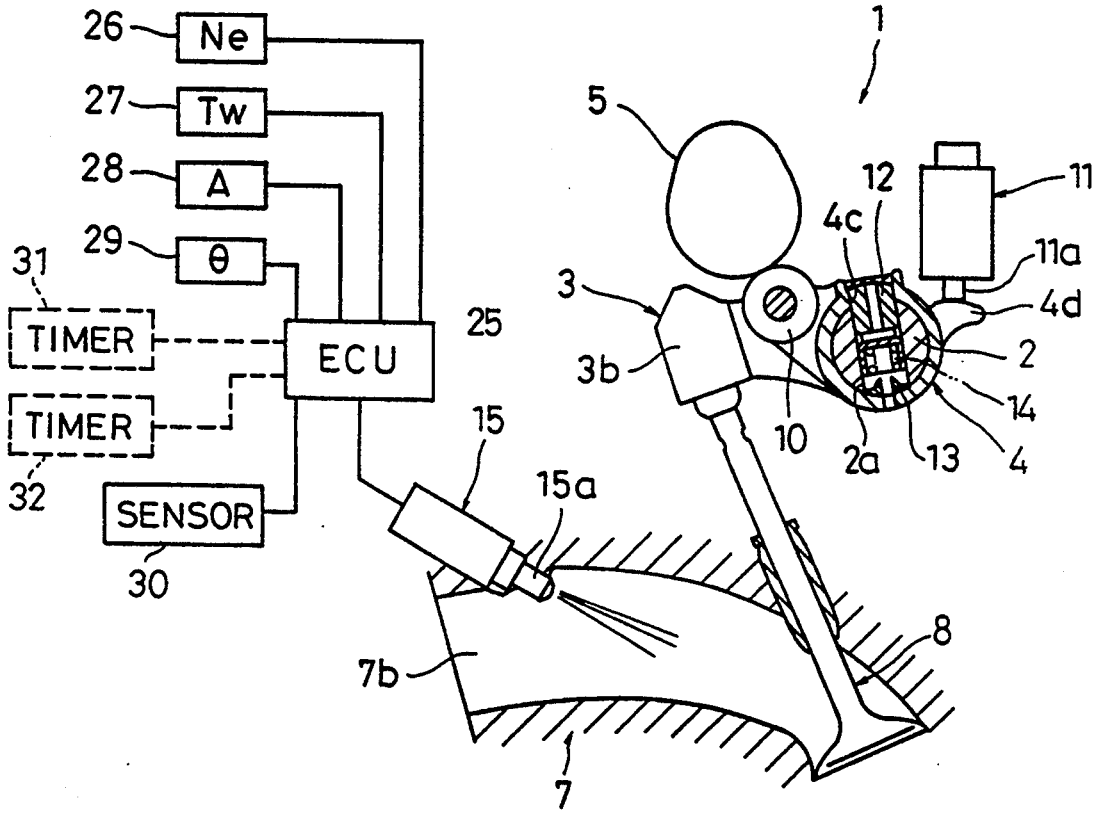
FIG. 4 is a fragmentary sectional view showing the valve drive mechanism of FIG. 2 in a cylinder-on state, along with a fuel injection system.

A piston 12, a spring seat 13, and a spring 14 are housed in the piston hole 2*a* of the rocker shaft 2. The spring 14, which is held compressed between the proximal end of the piston 12 and the spring seat 13, urges the piston 12 in the direction to push the piston 12 out from the piston hole 2*a*. When the piston 12 is not supplied with the hydraulic pressure P, it is pushed out from the piston hole 2*a* by the urging force of the spring 14 so that its distal end is fitted in the piston hole 4*c* of the rocker arm 4, thereby connecting the rocker arm 4 and the rocker shaft 2, as shown in FIGS. 3 and 4. Thus, the rocker arm 3 is connected to the rocker arm 4, and as the cam 5 rotates, the rocker arm 3 rocks to drive the suction valves 8, 8.

Figure 5:
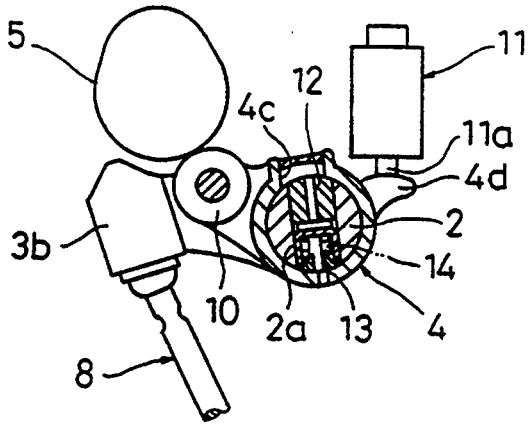
FIG. 5 is a view showing the valve drive mechanism of FIG. 2 in a cylinder-off state.

When the piston 12 is supplied with the hydraulic pressure P from the hydraulic circuit 20, moreover, the piston 12 is drawn into the piston hole 2*a* of the rocker shaft 2, resisting the urging force of the spring 13, as shown in FIG. 5, and its distal end is disengaged from the piston hole 4*c* of the rocker arm 2, so that the rocker arm 4 and the rocker shaft 2 are disconnected from each other. Even when the cam 5 rotates, therefore, the rocker arm 4 rotates idle without engaging the rocker shaft 2, so that the rocker arm 3 holds the suction valves 8, 8 in a closed state without driving them, whereby the cylinders concerned are in an off-state. At this time, the rocker arm 4 is prevented from springing up, in a manner such that the roller 10 is held against the cam 5 by unit of the lost motion assembly 11.

Each valve drive mechanism (not shown) on the exhaust side, which is constructed in the same manner as the suction-side valve drive mechanism 1 described above, ceases to drive an exhaust valve for its corresponding cylinder and keeps the valve closed when in the cylinder-off state. The valve drive mechanisms are switched for the cylinders #1, #3 and #5 in the case of the 6-cylinder engine, for example, and both suction and exhaust valves for each of these three cylinders cease to be driven and are closed when the engine is in the cylinder-off state.

A fuel injection valve (injector) 15 is mounted in position near an open end of a suction passage 7*b* (FIG. 4) of the cylinder head 7, and its nozzle 15*a* is located facing the suction valves 8. The fuel injection valve 15 is connected to the electronic control unit (hereinafter referred to as ECU) 25.

The ECU 25 receives signals from various sensors for detecting the operating conditions of the engine, e.g., an engine speed sensor 26, an engine water temperature sensor 27, an airflow sensor 28, a throttle sensor 29, etc. Based on these signals, an optimum amount of fuel supply is determined by unit of a microcomputer (not shown), whereby the fuel injection valve 15 is controlled to be opened. Thus, the ECU 25 controls the engine in order to reduce harmful gas while producing an optimum air-fuel mixture (air-fuel ratio) in accordance with various conditions, such as the engine lead, drive conditions, etc., and enjoying high output and reasonable fuel-cost performance.

Further, the ECU 25 has a function to control the valve drive mechanisms and a fuel injection system during the change between the cylinder-off state and the cylinder-on state of the engine. In other words, the ECU 25 combines the respective functions of the cylinder-off condition discriminating unit 41 and the fuel injection control unit 42 of FIG. 1, and also serves, in cooperation with the throttle sensor 29, as the rapid acceleration detecting unit 45, for example. In conjunction with the hydraulic circuit 20, the piston 12, etc., moreover, the ECU 25 functions as the valve operation limiting unit 44. Furthermore, the ECU 25 is connected to valve operation sensors 30 which are provided individually for the respective suction-side valve drive mechanisms of the suspendible cylinders and function as the valve operation detecting means 43 of FIG. 1. Each valve operation sensor 30 is formed of, for example, a switch or a sensor for mechanically detecting the opening operation of the suction valve for the suspendible cylinder, or a proximity sensor for electrically detecting the operation.

Referring now to FIGS. 2 to 6, the control of the valve drive mechanisms and the fuel injection system by unit of the ECU 25 will be described.

Figure 6:
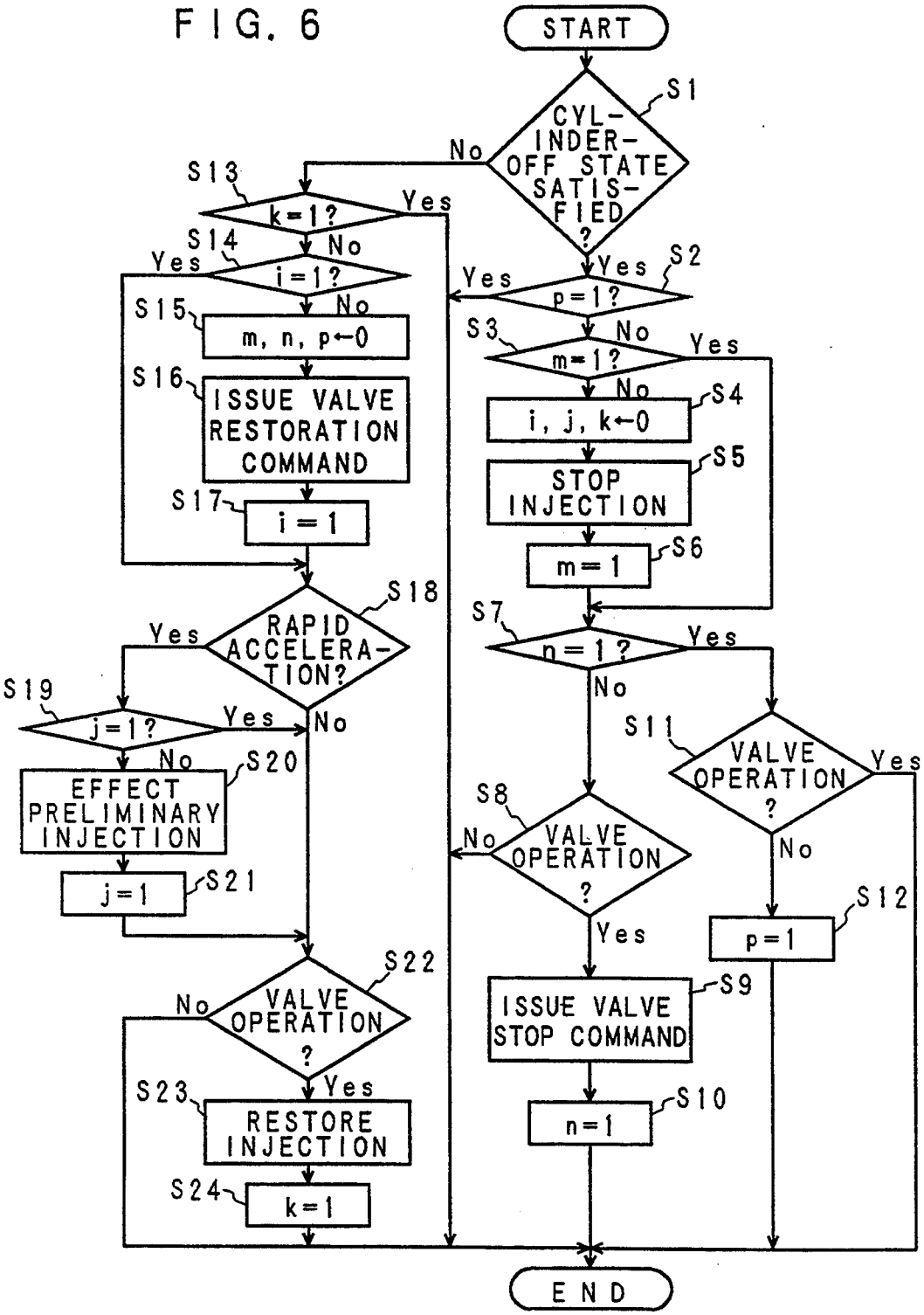
FIG. 6 is a flow chart showing a control routine for the valve drive mechanism and the fuel injection system used in the control method according to a first embodiment of the present invention.

During the engine operation, the ECU 25 periodically executes the control routine shown in FIG. 6 while periodically executing other control routines, such as fuel injection quantity control (not shown). In an initialization process performed upon activation of an ignition key, the respective values of control indexes i, j, k, m, n and p (mentioned later) are reset to the value "0."

In each control cycle of the control routine of FIG. 6, the ECU 25 determines whether or not the cylinder-off conditions are satisfied (Step S1). If the ECU 25 sees, in accordance with the various sensor signals, that the engine is in the low-load operation region, which does not include an acceleration operation region, and that the engine water temperature is not lower than 70° C., for example, it is then concluded that time engine is in a specific operation region, and therefore, the cylinder-off conditions are satisfied. If the cylinder-off conditions are satisfied, the ECU 25 determines whether or not the index p has the value "1" which is indicative of the completion of switching control (hereinafter referred to as first switching control) for the transition from the cylinder-on state to the cylinder-off state (Step S2). If the decision is NO, that is, if it is concluded that the first switching control has not been finished, the ECU 25 further determines whether or not time index m has the value "1" which is indicative of the completion of a fuel injection stop process, which constitutes part of the first switching control (Step S3).

If the decision in Step S3 is NO, that is, if it is concluded that the first switching control should be started, the ECU 25 resets each of the indexes i, j, and k for second switching control (mentioned later) to the value "0" (Step S4), then stops the delivery of control signals to the fuel injection valves 15 associated with the suspendible cylinders, thereby stopping the fuel injection into the suspendible cylinders (Step S5), and sets time index m to time value "1" which is indicative of the completion of time fuel injection stop process (Step S6). Then, the ECU 25 determines whether or not the indexes (index of only one of the suspendible cylinders is designated by symbol n in FIG. 6) associated individually with the suspendible cylinders are already set to the value "1" which is indicative of the completion of the delivery of a valve stop command signal (Step S7). Since the decision in Step S7 immediately after the start of the first switching control is NO, the ECU 25 further determines, by a detection output from each of the valve operation sensors, whether or not the suction valve for each corresponding suspendible cylinder is opened (Step S8). If it is concluded in Step S8 that the suction valve has not been opened yet, the first switching control of FIG. 6 for the present cycle terminates.

If it is concluded in Step S8 of any subsequent cycle that the suction valve has been opened, the ECU 25 delivers a valve stop command signal to the hydraulic circuit 20 associated with the cylinder concerned (Step S9), and sets the index n to the value "1" which is indicative of the completion of the signal delivery (Step S10), whereupon the switching control for the present cycle ends. If n=1 is discriminated in Step S7 of the next cycle or any of its subsequent cycles, the program proceeds to Step S11. If it is concluded in Step S11 that the suction valve has been closed and the air suction into the associated suspendible cylinders has been finished, the index p is set to the value "1" which is indicative of the completion of the first switching control (Step S12).

Although only one of the suspendible cylinders is illustrated in FIG. 6, with respect to Steps S7 to S12, for simplicity, the control routine including Steps S7 to S12 is executed for each of the suspendible cylinders. To attain this, indexes n1 to n3 and p1 to p3, which correspond to the indexes n and p, and an index ni for an update process are used, for example, and Steps S7 to S12 are executed with the index ni set to the value "1" between Steps S6 and S7. When the air suction into the cylinder #1 is finished, the index p1 is set to the value "1," the index ni is updated to take the value "2," and Steps S7 to S12 are executed. Upon completion of the air suction into the cylinder #3, the index p2 is set to the value "1," the index ni is updated to the value "3," and Steps S7 to S12 are executed. When the air suction into the cylinder #5 is finished, moreover, the index p3 is set to the value "1," whereupon the first switching control ends.

When the valve stop command signal is delivered from the ECU 25 in Step S9 of the switching control described above, the hydraulic circuit 20, which operates in response to this signal, supplies the predetermined hydraulic pressure P to the valve drive mechanism 1 (FIG. 3), thereby causing the piston 12 to be drawn into the piston hole 2*a* of the rocker shaft 2, so that the rocker shaft 2 and the rocker arm 4 are disconnected from each other. Thus, the cylinder concerned is de-energized. As air is sucked (hereinafter referred to as "air cycle") at least once into each de-energized cylinder immediately before the cylinder is de-energized, combustion gas can be prevented from being confined to the cylinder concerned.

Figure 8:
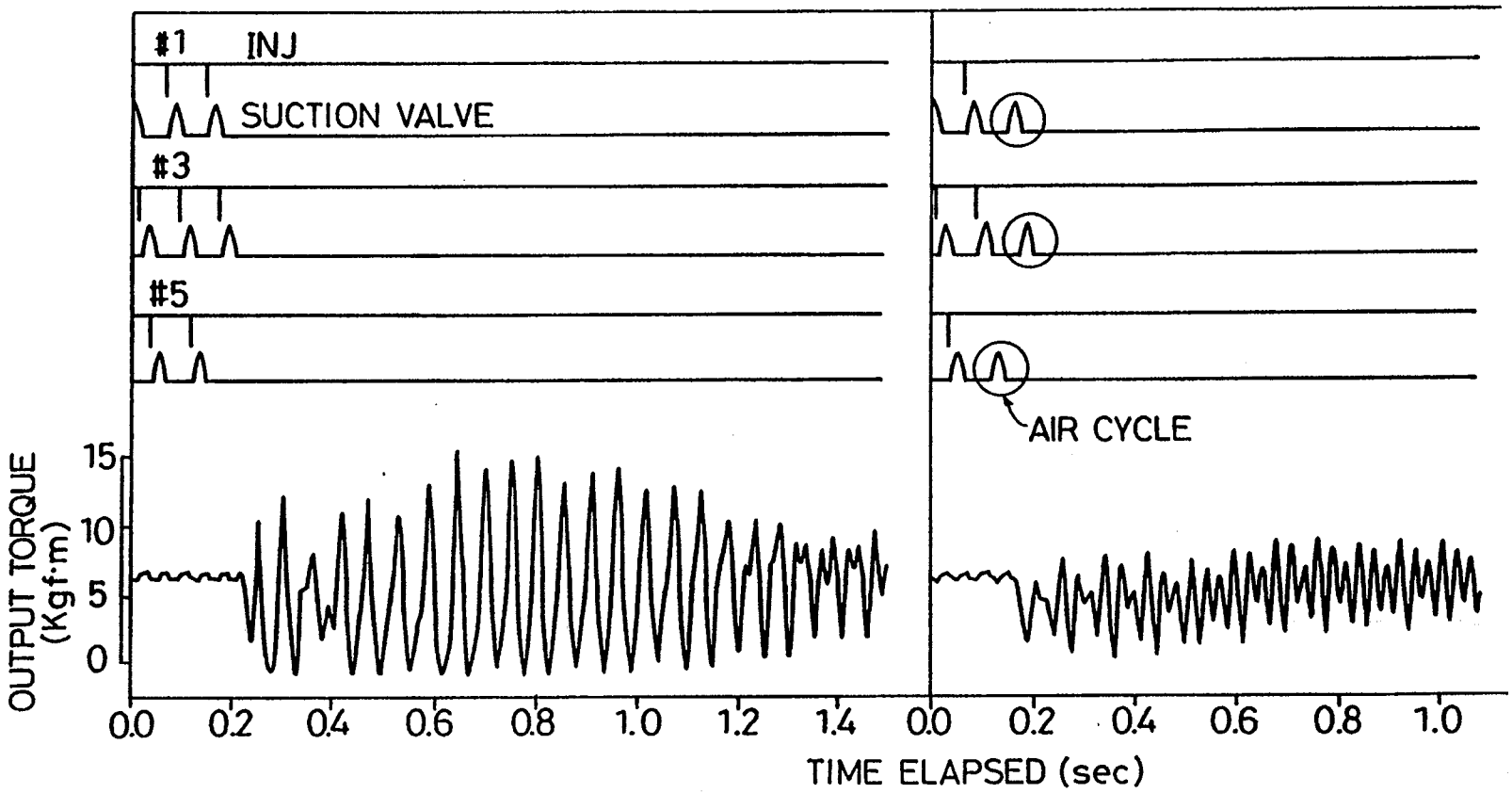
FIGS. 8(*a*) and FIG. 8(*b*) are diagrams showing the behavior of an engine during restoration from the cylinder-on state to the cylinder-off state.

FIG. 8(*a*) illustrates the way the engine behaves as its operating state is changed from the cylinder-on state to the cylinder-off state when the fuel injection into each of the three cylinders #1, #3 and #5 of the 6-cylinder engine is effected to a degree such that the cylinder-off state is almost established, in suspending the operation of the cylinders #1, #3 and #5. FIG. 8(*a*) indicates very great fluctuations of the output torque. The output torque fluctuations are considered to be attributable to confinement of high-pressure combustion gas to the cylinders caused by the fuel injection up to a point of time immediately before the establishment of the cylinder-off state. FIG. 8(*b*) illustrates like behavior of the engine observed when the air cycle (circled in the drawing) is provided immediately before the establishment of the cylinder-off state. According to the engine control method for an embodiment of the present invention in which the air cycle is provided, the fluctuations of the outpost torque of the engine during the transition from the cylinder-on state to the cylinder-off state are reduced more sharply than in the case where the fuel injection is continued up to the point of time immediately before the establishment of the cylinder-off state, as seen from the comparison between FIGS. 8(*a*) and 8(*b*). Also observed is an effect on the smoldering of the spark plugs.

When the engine gets out of the specific operation region so that the cylinder-off conditions are canceled, thereafter, the ECU 25 concludes in Step S1 of FIG. 6 that the cylinder-off conditions are not satisfied. In this case, the ECU 25 determines whether or not the index k is set to the value "1" which is indicative of the completion of the switching control (hereinafter referred to as second switching control) for the transition from the cylinder-off state to the cylinder-on state (Step S13). Since the cylinder-on state is not established in this case, the decision in Step S13 is NO, so that the ECU 25 further determines whether or not the index i is set to the value "1" which is indicative of the completion of the delivery of a valve restoration command signal, which constitutes part of the second switching control (Step S14). Since the decision in Step S14 is NO in this case, the ECU 25 resets each of the indexes m, n and p used in the first switching control to the value "0" (Step S15), then delivers the valve restoration command signal to the hydraulic circuit 20 (Step S16) , and sets the index i to the value "1" which is indicative of the completion of the signal delivery (Step S17).

On receiving the valve restoration command signal, the hydraulic circuit 20 stops the hydraulic pressure supply to the valve drive mechanism 1. As a result, the piston 12, urged by the urging force of the spring 14, projects from the piston hole 2*a* of the rocker shaft 2 so that its distal end is fitted in the piston hole 4*c* of the rocker arm 4, thereby connecting the rocker arm 4 and the rocker shaft 2. Thus, the cylinder-off state is removed.

Then, based on a throttle opening changing rate which is computed on the basis of an output signal from the throttle sensor 29, for example, the ECU 25 determines whether or not the engine is in the rapid-acceleration operation region (Step S18). If the decision is YES, the ECU 25 further determines whether or not the index j is set to the value "1" which is indicative of the completion of the preliminary fuel injection (Step S19). If the index j is not set to the value "1," the ECU 25 drives the fuel injection valve 15 so that the preliminary fuel injection from the injection valve 15 into each of the suspendible cylinders is carried out once (Step S20), and sets the index j to the value "1" which is indicative of the completion of the preliminary fuel injection (Step S21).

Then, based on the output of each valve operation sensor 30, the ECU 25 determines whether or not the suction valves 8 (FIG. 2) of the suspendible cylinders are opened (Step S22). If the decision in this step is YES, the ECU 25 allows the fuel injection from the fuel injection valve 15 to the suspendible cylinders, thereby restoring the fuel injection (Step S23). In this case, the index k is set to the value "1" which is indicative of the completion of the second switching control, whereupon the second switching control terminates.

In FIG. 6, Steps S22 to S24 are collectively shown with respect to the three suspendible cylinders for simplicity of illustration. Practically, however, Steps S22 to S24 are executed for each cylinder.

Since the preliminary fuel injection is carried out immediately before the opening operation of the suction valve, as described above, normal combustion can be effected upon restarting the opening operation of the suction valve for each suspendible cylinder, thus fulfilling the requirement for the rapid-acceleration operation region that the engine output should be increased at once.

If it is concluded, in Step S22 immediately after the preliminary fuel injection, that the suction valve opening operation has not been executed yet, the second switching control for the present cycle terminates, and the fuel injection is restarted when it is concluded in Step S22 that the valve operation has been performed.

If it is concluded in Step S18 of the second switching control that the engine is not in the rapid-acceleration operation region but in the normal operation state, on the other hand, the ECU 25 proceeds to Step S22 without executing the preliminary fuel injection, whereupon the ECU 25 determines whether or not the suction valve opening operation has been performed, and then restarts the fuel injection. Thus, at least one air cycle (suction stroke) is executed immediately before the fuel injection. In consequence, a restoration shock or the like can be prevented which is attributable to an excessive torque produced when the normal combustion has been effected since the point of time immediately after the restart of the opening operation of the suction valve for each suspendible cylinder.

Figure 9:
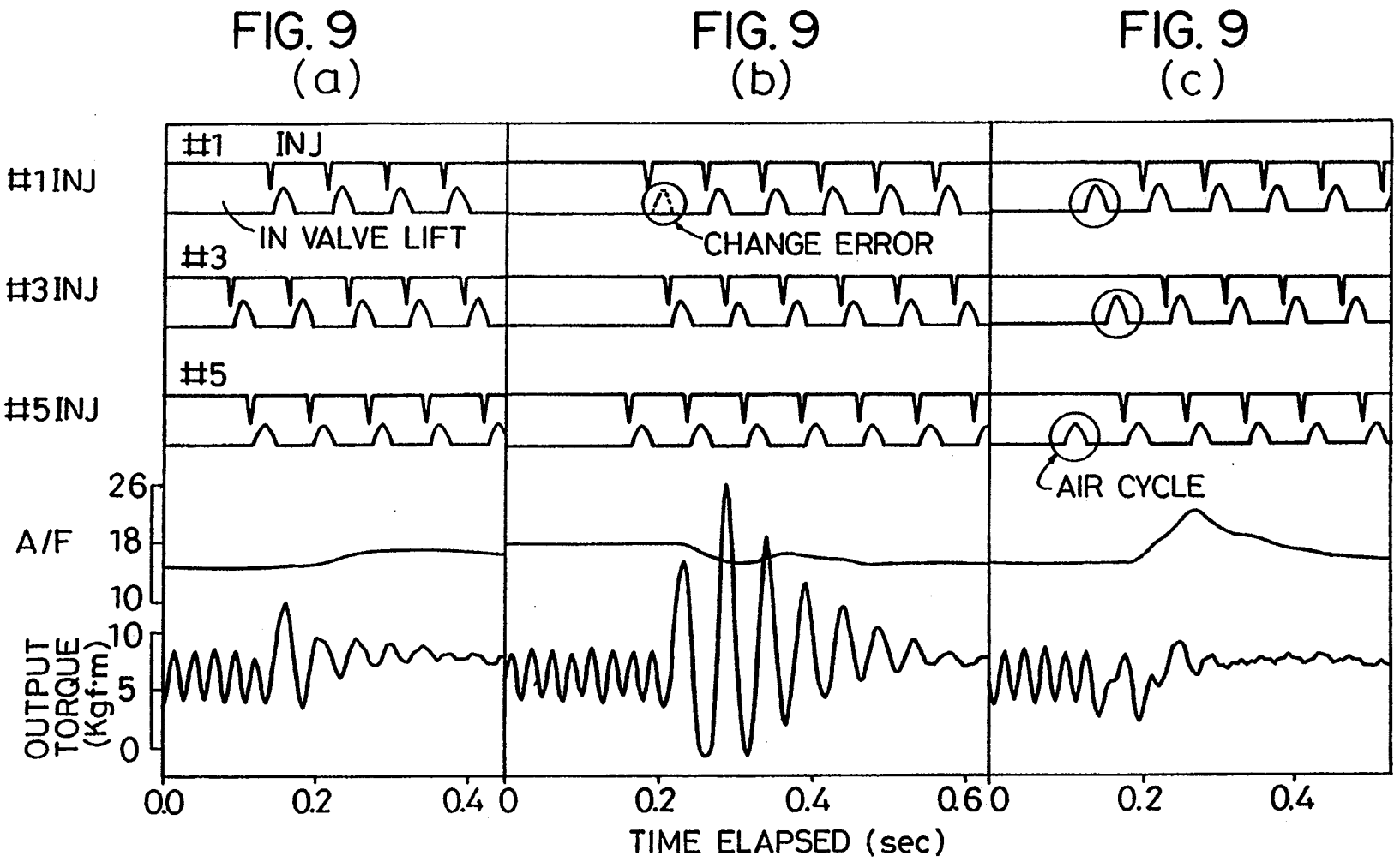
FIGS. 9(*a*) to FIG. 9(*c*) are diagrams showing the behavior of the engine during transition from the cylinder-off state to the cylinder-on state.

As described above, if the engine is in the rapid-acceleration operation region while the operating state is returned from the cylinder-off state to the cylinder-on state, the fuel injection is carried out once in advance so that the normal combustion can be started immediately after restoration of the valve operation. If the engine is in the normal state, the fuel injection is started after the restoration of the valve operation so that only air is sucked in temporarily. FIG. 9(*c*) illustrates the way the engine behaves when the air cycle (circled in the drawing) is provided for each cylinder as the operating state is returned from the cylinder-off state to the cylinder-on state. As seen from this drawing, fluctuations of the output torque are small, and the restoration shock can be reduced considerably. FIG. 9(*a*) illustrates the way the engine behaves when the fuel injection timing agrees with the valve-opening time of the suction valve as the operating state is returned from the cylinder-off state to the cylinder-on state. FIG. 9(*a*) indicates relatively great fluctuations of the output torque. FIG. 9(*b*) indicates that the output torque fluctuations become very great if a certain cylinder, e.g., cylinder #1, is subject to a suction valve change error (indicated by dotted line in the drawing).

The following is a description of an engine control method according to a second embodiment of the present invention.

The method of the present embodiment has been contrived in consideration of the fact that the operations for the disconnection and connection between the rocker shaft 2 and the rocker arm 4 of the valve drive mechanism shown in FIGS. 2 to 5 are performed with a practical delay behind the valve stop command and valve restoration command from the ECU 25, and therefore, the detection of the valve operation requires use of a complicated system. Thus, the present embodiment is intended to provide a highly practical engine control method which can be carried out by unit of an apparatus with a simple construction.

To attain this, the apparatus for carrying out the method of the present embodiment, which is constructed substantially in the same manner as the apparatus shown in FIGS. 2 to 5, differs from the precedent mainly in that two timers, which are denoted individually by reference numerals 31 and 32 in FIG. 4, are used in place of each valve operation sensor 30 as the valve operation detecting unit 43.

Figure 7:
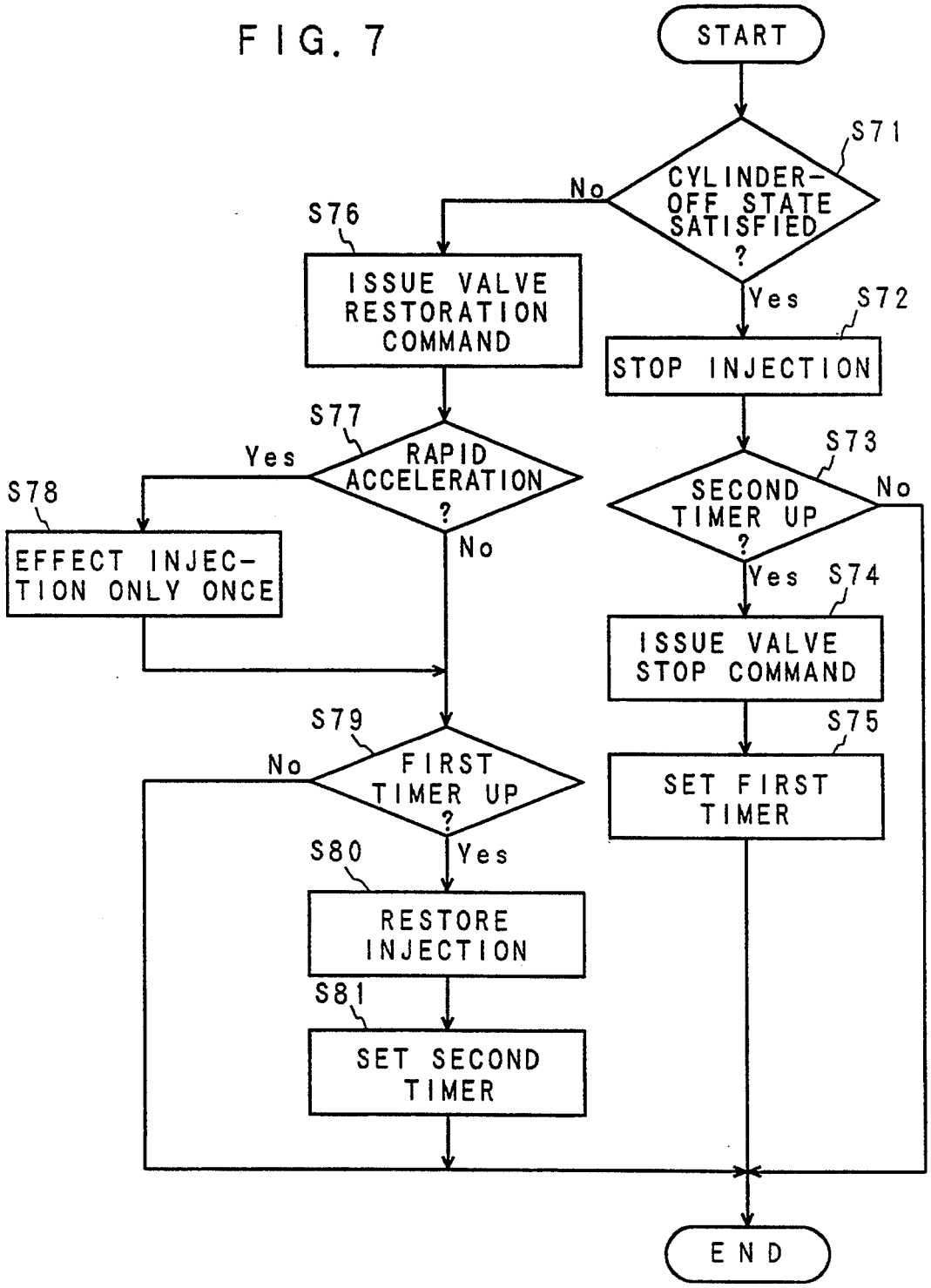
FIG. 7 is a flow chart showing a control routine for the valve drive mechanism and the fuel injection system used in a control method according to a second embodiment of the present invention.

As shown in FIG. 7, first and second switching controls according to the method of the second embodiment are effected substantially in the same manner as in the case of the method of the first embodiment shown in FIG. 6.

More specifically, if it is concluded, in Step S71 which corresponds to Step S1 of FIG. 6, that the cylinder-off conditions are satisfied, the ECU 25 stops the delivery of a valve opening control signal to the fuel injection valves 15 in Step S72 which corresponds to Step S5, and delivers the valve stop command signal to the hydraulic circuit 20 (Step S74 corresponding to Step S9) after the preset time of the second timer 32, which starts operating when the signal delivery is stopped and determines the lapse of time thereafter, is up, thereby effecting the first switching control for the transition from the cylinder-on state to the cylinder-off state. When the first switching control is completed, the ECU 25 sets the preset time of the first timer 31 for the second switching control in consideration of the delay of the operation for the connection between the rocker shaft 2 and the rocker arm 4 of each valve drive mechanism, compared with the valve restoration command (Step S75).

If it is concluded in Step S71 that the cylinder-off conditions are not satisfied, on the other hand, the ECU 25 delivers the valve restoration command in Step S76 which corresponds to Step S16. If it is then concluded, in Step S77 which corresponds to Step S18, that the engine is being operated in the rapid-acceleration operation region, the preliminary fuel injection is carried out once in Step S78 which corresponds to Step S20, and the fuel injection is restarted (Step S80 corresponding to Step S23) after the first timer 31, which starts operating in response to the valve reset command and determines the lapse of time thereafter, is up (Step S79), whereupon the second switching control for the transition from the cylinder-off state to the cylinder-on state terminates. When the second switching control terminates, the preset time of the second timer 32 for the first switching control is set in consideration of the delay of the operation for the disconnection between the rocker shaft 2 and the rocker arm 4 of each valve drive mechanism, compared with the valve stop command (Step S81).

In FIG. 7 illustration of processes, such as processes corresponding to the setting and resetting processes for the various control indexes shown in FIG. 6, is omitted for simplicity.

The method of the second embodiment has not only the above-described advantage that it can be carried out by unit of the apparatus with a simple construction, but also an advantage such that the fluctuations of the output torque, which accompany the transition between the cylinder-off state and the cylinder-on state, can be reduced, as in the method of the first embodiment. By suitably setting the respective preset times of the first and second timers 31 and 32, moreover, a shock attributable to a suction valve change error can be reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. In an engine control method in which valve operation in a valve drive mechanism associated with at least one specific cylinder is limited to permit a reduction in the number of operating cylinders, and fuel injection is controlled depending on the operating conditions of said valve drive mechanism, while an engine is being operated in a specific operation region, the engine control method comprising the steps of:

previously injecting fuel into said specific cylinder, then restoring the valve operation in the valve drive mechanism associated with said specific cylinder, and effecting normal combustion in said specific cylinder on restoring the valve operation, during the change of the operating state of the engine from a cylinder-off state to a cylinder-on state when the engine is in a rapid-acceleration operation region; and restoring the valve operation in the valve drive mechanism associated with said specific cylinder and then starting fuel injection into said specific cylinder, during the change of the engine operating state from said cylinder-off state to said cylinder-on state when the engine is in a normal operation region.

2. In an engine control method in which valve operation in a valve drive mechanism associated with at least one specific cylinder is limited to permit a reduction in the number of operating cylinders, and fuel injection is controlled depending on the operating conditions of said valve drive mechanism, while an engine is being operated in a specific operation region, the engine control method comprising the step of:

stopping fuel injection into said specific cylinder and then stopping the valve operation in the valve drive mechanism associated with said specific cylinder after at least one suction stroke is executed in said specific cylinder, during the change of the operating state of the engine from a cylinder-on state to a cylinder-off state.

3. A control method for an engine according to claim 2, further including the steps of:

previously injecting fuel into said specific cylinder, then restoring the valve operation in the valve drive mechanism associated with said specific cylinder, and effecting normal combustion in said specific cylinder on restoring the valve operation, during the change of the operating state of the engine from said cylinder-off state to said cylinder-on state when the engine is in a rapid-acceleration operation region; and restoring the valve operation in the valve drive mechanism associated with said specific cylinder and then starting fuel injection into said specific cylinder, during the change of the engine operating state from said cylinder-off state to said cylinder-on when the engine is in a normal operation region.

* * * * *